US006540121B1

(12) United States Patent
Harvey

(10) Patent No.: US 6,540,121 B1
(45) Date of Patent: Apr. 1, 2003

(54) COLLAPSIBLE GARMENT HANGER

(75) Inventor: Kevin A. Harvey, Camarillo, CA (US)

(73) Assignee: Harvey & Harvey, LLC, Camarillo, CA (US)

( * ) Notice: Subject to any disclaimer, the term of this patent is extended or adjusted under 35 U.S.C. 154(b) by 0 days.

(21) Appl. No.: 10/013,436

(22) Filed: Dec. 7, 2001

(51) Int. Cl.[7] ..... A41D 27/22
(52) U.S. Cl. ..... 223/85; 223/89; 223/94
(58) Field of Search ..... 225/85, 89, 94

(56) References Cited

U.S. PATENT DOCUMENTS

| | | | | | |
|---|---|---|---|---|---|
| 586,456 | A | * | 7/1897 | Rideout | 223/94 |
| 589,901 | A | * | 9/1897 | Lincoln et al. | 223/94 |
| 713,376 | A | | 11/1902 | Baer | |
| 834,946 | A | * | 11/1906 | Sugrue | 223/94 |
| 896,570 | A | * | 8/1908 | Noble | 223/94 |
| 923,786 | A | * | 6/1909 | Geraci | 223/94 |
| 959,687 | A | * | 5/1910 | Altermatt | 223/94 |
| 1,066,170 | A | * | 7/1913 | Wesner | 223/94 |
| 1,184,288 | A | * | 5/1916 | Wesner | 223/94 |
| 1,356,448 | A | * | 10/1920 | Harris | 223/94 |
| 1,385,449 | A | * | 7/1921 | Heinle | 223/94 |
| 1,495,425 | A | * | 5/1924 | Moss | 223/94 |
| 1,676,936 | A | * | 7/1928 | Trevino | 223/94 |
| 1,769,076 | A | * | 7/1930 | Shrack | 223/94 |
| 2,137,700 | A | * | 11/1938 | Reehl | 223/94 |
| 2,166,492 | A | * | 7/1939 | Harvey | 223/94 |
| 2,235,439 | A | * | 3/1941 | Lion | 105/354 |
| 2,290,722 | A | * | 7/1942 | Weingarten | 223/94 |
| 2,509,754 | A | * | 5/1950 | Badalamenti | 223/94 |
| 2,518,367 | A | * | 8/1950 | Penhallegon | 223/94 |
| 2,569,726 | A | | 10/1951 | McPherson | |
| 2,586,913 | A | | 2/1952 | Burns | |
| 2,653,739 | A | * | 9/1953 | Zenk | 223/94 |
| 2,716,513 | A | * | 8/1955 | Braunstein | 223/94 |
| 2,728,499 | A | | 12/1955 | Mueller | |
| 2,754,038 | A | * | 7/1956 | Varker | 223/94 |
| 2,777,621 | A | * | 1/1957 | Murray | 223/94 |
| 2,782,969 | A | * | 2/1957 | Murray | 223/94 |
| 2,872,090 | A | | 2/1959 | Goodman | |
| 2,906,442 | A | * | 9/1959 | McNutt | 223/94 |
| 3,531,028 | A | | 9/1970 | Vazquez | |
| 3,858,770 | A | * | 1/1975 | Murray | 223/94 |
| 4,114,786 | A | * | 9/1978 | Wiese | 223/94 |
| 4,186,857 | A | | 2/1980 | Helms | |
| 4,227,632 | A | | 10/1980 | Collis | |
| 4,673,116 | A | | 6/1987 | Keller | |
| 4,730,757 | A | | 3/1988 | Keller | |
| 4,813,581 | A | | 3/1989 | Lamont | |
| 4,948,019 | A | | 8/1990 | Rodum | |
| 5,397,037 | A | | 3/1995 | Ozawa | |
| 5,590,823 | A | | 1/1997 | Lunde | |

* cited by examiner

*Primary Examiner*—John J. Calvert
*Assistant Examiner*—James G Smith
(74) *Attorney, Agent, or Firm*—Lyon & Harr, LLP; Richard T. Lyon

(57) ABSTRACT

A collapsible garment hanger including a hook, first and second supporting arms, at least one spring element, and in some versions, a base. The first and second supporting arms are each connected to the hanger by means of integrally molded hinges. Each spring element is hingedly attached to the hook or base at one terminal point and to the first or second supporting arm at the opposite terminal point. The first and second supporting arms can be collapsed with one hand by forcing supporting arms to pivot at their hinge point, thereby allowing for easy insertion into the neck of a garment. This collapsing of the arms causes each spring element to elastically stretch or compress depending on its orientation creating an upward force on the arms which returns them to their original extended position once the user lets go of the supporting arms.

20 Claims, 10 Drawing Sheets

COLLAPSIBLE GARMENT HANGER

BACKGROUND

Technical Field

The present invention is generally related to the field of garment hangers, and specifically to a one-piece molded plastic collapsible garment hanger.

Background Art

Garments are sometimes overly stretched and/or damaged as a result of being removed from and placed on rigid hangers in the conventional manner. In addition, the convenience of removing the hanger is impeded by its rigidity.

The stretching of a garment usually occurs because the distance between the hanger arms is greater than the opening of the neck of the garment. To prevent damage to some types of clothing, hangers must be separated from the garment by manipulating the hanger down through the bottom of the garment. In so doing, the hook element may damage the garment. If the garment is a button type, the necessary number of buttons must be undone before removal.

Because of the small necks of some garments, garment hanger manufacturers have attempted to compensate for this problem by making the arm-spans of hangers short enough to manipulate into the necks of most garments. However, the short spans of the hanger arms are inadequate to support the average garment shoulder width.

Certain collapsible garment hangers have been introduced to remedy the deficiencies of rigid garment hangers. In one such device, the hanger has two arms that fold downward after a locking member is released. It also latches with a locking mechanism in the folded position. However, in this design, the release mechanisms need to be manually activated (say with a second hand) in order to release the hanger in either of its locked positions.

In another collapsible garment hanger device, the hanger has hinged elements molded into the mechanism that allow movement so as to latch the hanger in the up position. Application of a force on the center locking components of this device act to release the lock and allow the hanger arms to fold downward. However, in the collapsed position the arms extend outward at an angle of perhaps 40 degrees on either side, restricting its use to large necked garments. In addition, the release mechanism of this device must also be manually activated to release the hanger arms.

In yet another existing collapsible garment hanger device, the hanger has molded hinges and a spring element that allows the arms to latch in the up position. However, like the previous two device described above, a force must be applied to the locking spring element in order to unlatch it. Further, positive actions are required by the user to move the arms from one position to the other. Generally, two hands (or two sequential actions of one hand) are needed to hold and activate the release, and to allow movement to the second latched position.

In still another existing collapsible garment hanger device, the device takes the form of a three-member latching hanger with three separately assembled hinges. A positive squeezing action is needed to unlock the hinge locking mechanism. However, the squeezing force required to release the hanger is significantly larger than the weight of the garment. An alternative version of this design allows for heavier garments by included a fourth, sliding member to latch one of the hinges. However, in this alternate version, manual operation of the sliding member is needed as an additional step in collapsing the hanger.

SUMMARY

The present invention is directed toward a garment hanger that allows the arms of the hanger to be collapsed. This allows garments, and especially small-necked garments such as shirts, blouses and dresses, to be removed from, and placed onto the hanger, with relative ease and without stretch or hook damage. In general, the present collapsible garment hanger is a one-piece molded structure that includes a hook, two arms, at least one spring element, and in some versions, a base. The spring element or elements allow the hanger to be collapsed with one hand and without manual release of some type of locking mechanism, unlike most existing designs. Essentially, the spring or springs provide a positive force that maintains the arms at a desired angle in an extended position for a wide variety of garment weights. In addition, the spring or springs are configured so as to minimize the force required to collapse the hanger and to hold the hanger arms in the collapsed position. Specifically, the spring or springs can be configured to limit the maximum force required to collapse the hanger to be just beyond that of the maximum garment weight intended for the hanger, thereby resolving one of the drawbacks of some existing collapsible garment hangers. It is also noted that the collapsed position of the arms is such that the hanger will easily fit through the neck opening of most any garment being hung with the present hanger. Further, the spring or springs are configured to provide a small restoring force, thus allowing the hanger arms to spring back from the collapsed position when the collapsing force exerted by the user is removed. However, unlike some of the existing designs described previously, the arms do not lock when the hanger arms are collapsed, and so no manual release is required to return the arms to their extended position.

In one version of a collapsible garment hanger according to the present invention, a single spring element is employed that provides for a single-pivot spring action. Specifically, the hanger includes a hook element, which typically resembles the hook portion of any standard clothes hanger. There are also two supporting arms which act to support the garment being hung. These supporting arms are connected pivotally at one end by a hinge. A spring element extends at its midpoint from said hook element with one end terminating at one of the arms and the second end terminating at the other arm. The spring element is connected at its ends to the respective supporting arms by hinges. The spring element imparts a small upwardly-directed bias force to the supporting arms, which keeps them in the aforementioned outwardly extended position. In addition, when a downward force is applied by a user to the supporting arms that just exceeds the biasing force, the supporting arms rotate about their common hinge into the aforementioned collapsed position. As the supporting arms move into the collapsed position, the spring element elastically stretches, thereby creating an upward force that will return the arms to their extended position when the user-applied downward force is removed.

Multiple spring elements can also be employed in a nested pattern. This configuration allows the weight-bearing capacity of the hanger to be distributed among the multiple springs, thereby allowing each spring to be of smaller size than if just one spring were employed. Structurally, the multiple spring version would include at least one additional spring element, each of which is attached via hinges at their ends to the respective supporting arms, just as in the case of the primary spring. Each additional spring would extend between its ends within the boundary created the inward-facing surface of the next adjacent, outwardly-positioned spring element, thereby forming the aforementioned nested configuration.

The above-described multiple-spring hanger configuration could be further modified to allow customization of its weight handling capacity by the user. Essentially, this is accomplished by making the aforementioned additional spring elements of a removable type so the user can self-adjust the hanger collapsing force by adding or removing spring elements. For example, the locations on the supporting arms where the additional spring elements are attached could include a slot and the ends of the additional spring elements a nub that fits into and is secured within the slot. In this way the additional spring elements become push-in springs.

A color coding scheme can be implemented to differentiate the weight handling capacities of the collapsible garment hanger. For example, the color coding scheme as applied to a version of the hanger not employing removable spring elements involves making the entire hanger or a part thereof a prescribed color representing its weight handling capacity. As for a hanger according to the present invention that does employ the removable spring elements, a spring element (removable or not) is made a color which represents the incremental amount of weight the spring adds to the overall weight handling capacity of the hanger. In this way a user simply adds up the incremental weight handling capacities associated with each spring installed on the hanger to arrive at the overall capacity.

In an alternate version of a collapsible garment hanger according to the present invention, one or more pairs of spring elements are employed with a different one of the spring elements of each pair being used to control the movement of each supporting arm, thus providing a double-pivot spring action. This double-pivot spring action has the advantage of each pivotal range of motion required of a spring element to be half of that required in the single-pivot spring action version described previously. Specifically, one embodiment of this alternate version of the collapsible garment hanger includes a hook and base structure made up of a hook-shaped piece such as described previously that extends from approximately the center of a traversely oriented base. A first of two supporting arms is attached via a hinge to one distally located end the base, while the second supporting arm is hingedly attached to the distally located end of the base opposite the attachment point of the first arm with the base. A first spring element is attached at a first end via a hinge to a point on the upper surface of the base between the hook-shaped piece and the attachment point of the first supporting arm to the base. The first spring element is attached at its other end to the first supporting arm, again via a hinge. Similarly, a second spring element is hingedly attached to a point on the upper surface of the base between the hook-shaped piece and the attachment point of the second supporting arm to the base at its first end and to the second supporting arm at its second end. These spring elements represent a spring pair as discussed previously. The first and second spring elements impart an upwardly directed bias force to the supporting arms so as to respectively keep them in the outwardly extended position. When a downward force is applied to the supporting arms by a user, which at least exceeds the biasing force, the supporting arms rotate about their respective hinged attachments with the base into the collapsed position. In addition, the spring elements stretch elastically creating an upward force which returns the arms to their extended position when the user-applied downward force is removed.

In yet another version of the present invention, the collapsible garment hanger is configured similar to the just described version, except that the spring elements are attached underneath the hanger as follows. The first spring element is attached via a hinge at a first end to a point on a lower surface of the base opposite the surface from which the hook-shaped piece extends, and at a second end via a hinge to the first supporting arm such that the first spring element straddles the attachment point of the first supporting arm to the base. Similarly, the second spring element of the pair is attached via a hinge at a first end to a point on a lower surface of the base opposite the surface from which the hook-shaped piece extends and at a second end to the second supporting arm such that the second spring element straddles the attachment point of the second supporting arm to the base.

The foregoing spring-pair versions of the collapsible garment hanger can also be configured to include the previously described multiple spring feature, which in this case would involve one or more additional spring pairs. Specifically, at least one additional pair of spring elements is added. In the case where the spring elements are attached above the base, each spring element of each pair is hingedly attached at one end on opposite sides of the hook-shaped piece to a point on the upper surface of the base between the hook shaped piece and the attachment point of the adjacent supporting arm, and to the adjacent supporting arm at a second end. In the case where the spring elements are attached below the base, each spring is hingedly attached at a first end to a point on a lower surface of the base opposite the surface from which the hook-shaped piece extends and at a second end to the adjacent supporting arm.

Further, the spring elements disposed on the same side of the hook-shaped piece are attached to the base and adjacent supporting arm so as to form a nested configuration. In this configuration each additional pair of spring elements imparts an additional upwardly directed bias force to the supporting arms. In addition, whenever a user applies a downward force to the supporting arms that at least exceeds the combined bias force exerted by each pair of springs, the supporting arms rotate about their hinged attachment with the base into the collapsed position. The spring elements stretch or compress elastically thereby creating a combined upward force which returns the arms to their extended position when the downward force is removed.

The multiple spring-pair versions of the collapsible garment hanger can also be modified to incorporate the previously described removable spring feature. Specifically, each spring element is not only hingedly attached, but also releasable attached to the base and adjacent supporting arm. Thus, pairs of spring elements can be installed or removed to control the magnitude of the bias force and the upward force.

The previously described color coding scheme can also be implemented in the multiple spring-pair versions of the present invention. In the case where the spring elements are removable, pairs of spring elements exhibiting the same weight capacity indicating color would preferably be added or removed as a pair from the hanger.

Another feature applicable to the multiple spring-pair versions of the collapsible garment hanger involves the use of stops referred to as pre-load stops. These stops are used to position the supporting arms in relation to the springs to impart the aforementioned bias force when the arms are in their extended position-thus the name pre-load stops. In addition, the stops can be used to create a desired angle between the supporting arms and the base when in the extended position to accommodate the sloping taper associated with most garments hung on a hanger. Generally, the stop feature is implemented by initially molding the supporting arms to attain an "at rest" angle higher than that desired angle intended for hanging garments. Prior to use, the supporting arms are pulled downward and the stops installed into the base at the support arm hinges. The stops restrict further upward motion of the arms to the desired angle while also providing a bias force on the arms that equals or exceeds that of the desired garment weight. Specifically, a pair of stops is employed. Each of these stops is connected to the base adjacent the hinged attachment between the base and a respective one of the supporting arms. The stops contact the supporting arms so as to interfere with their upward movement under the influence of the aforementioned upward force, thereby setting the angle of the supporting arms in relation to the base and the magnitude of the bias force. The stops can be integrally molded and fixed or removable by creating a releasable connection between the stops and the base. For example, removable stops could be configured so as to snap into a receptacle in the base. Further, the stops can be integrally molded and releasable. Specifically, each stop would be molded so as to be hingedly attached via a hinge to the base adjacent the hinged attachment between the base and the adjacent supporting arm. The stops would be folded down by rotating them about their hinge and snapped into place in the base. These stops then contact the supporting arms so as to interfere with their upward movement under the influence of the upward force supplied by the spring elements, thereby setting the angle of the supporting arms in relation to the base and the magnitude of the bias force. To disengage the stops, they are folded up by rotating them about their hinge into a retracted position, which prevents them from contacting the supporting arms and interfering with their upward movement.

In addition to the just described benefits, other advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

The present invention is generally related to garment hangers, and more specifically to collapsible garment hangers. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein. Furthermore it should be noted that unless explicitly stated otherwise, the figures included herein are illustrated diagrammatically and without any specific scale, as they are provided as qualitative illustrations of the concept of the present invention.

A collapsible garment hanger according to the present invention is a one-piece molded structure that includes a hook, two arms, at least one spring element, and sometimes a centralized base to which the other elements attach. The spring element or elements provide a biasing force that maintains the arms at a desired angle in an extended position for a wide variety of garment weights and allows the hanger to be collapsed with one hand. In addition, the spring or springs are configured so as to minimize the force required to collapse the hanger and to hold the hanger arms in the collapsed position. The spring or springs are also configured to provide a small restoring force, thus allowing the hanger arms to spring back from the collapsed position when the collapsing force exerted by the user is removed.

Figure 1A:
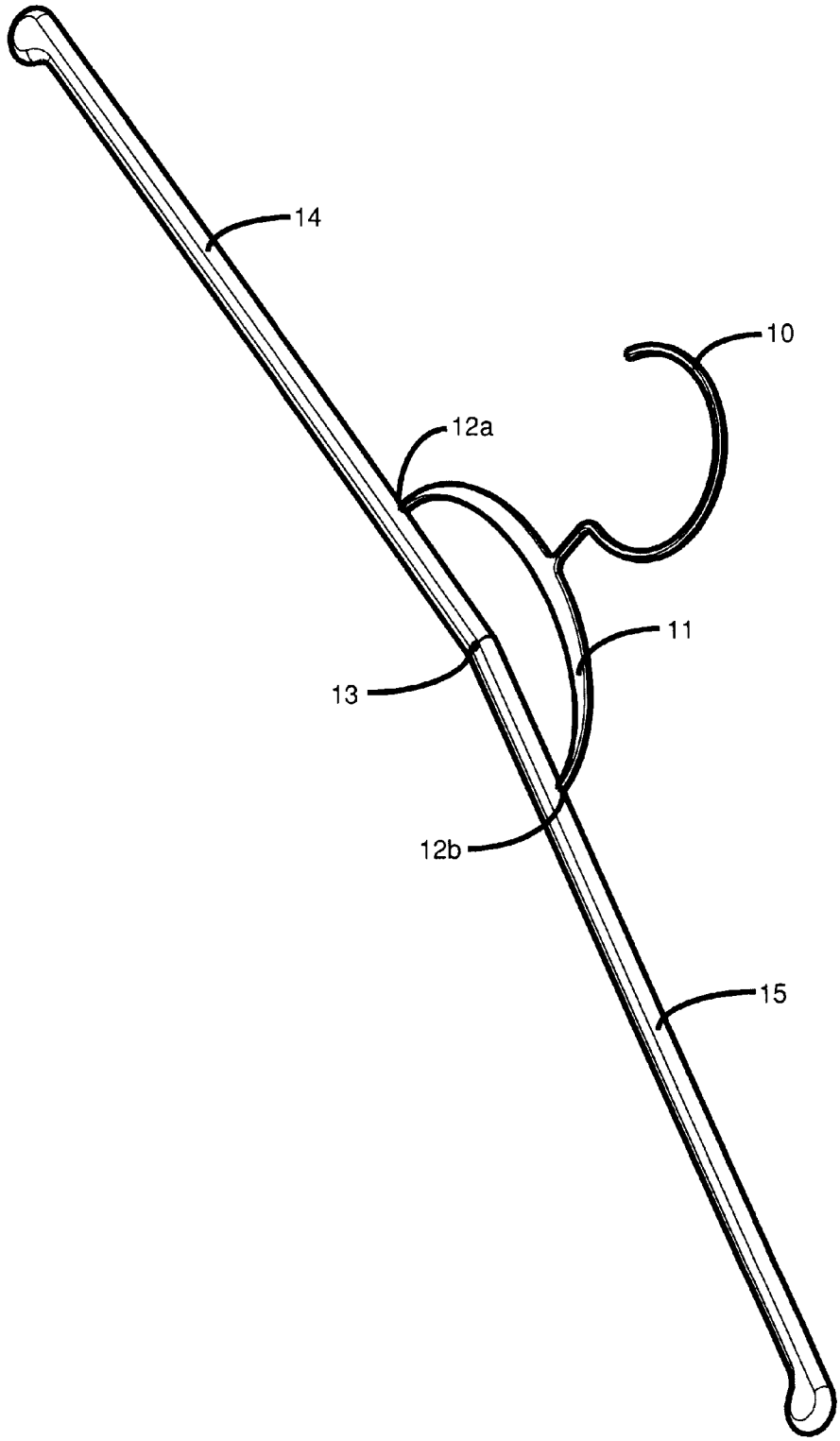
FIG. 1A is a side view of a version of a collapsible garment hanger according to the present invention showing the hanger in its extended position.

In one version of a collapsible garment hanger according to the present invention, a single spring element is employed as shown in FIG. 1A, where a side-view of the garment hanger in its extended position is presented. A hook element 10 is provided for supporting the garment hanger from a clothes rod. This hook element typically resembles the hook portion of any standard clothes hanger. However, it can also be made to resemble the hook portion of more specialized garment hangers, such as those designed to hang clothes from non-standard clothes rods which are typically smaller in diameter than standard rods. A spring element 11 is connected to the hook element 10 at a point of approximately equal distance from the distally located terminating points of the spring element 11. The spring element 11 is connected to a first supporting arm 14 and a second supporting arm 15 by hinges 12*a* and 12*b*. The first supporting arm 14 and the second supporting arm 15 are joined at a hinge 13, which acts as the pivoting point for the supporting arms 14 and 15.

Figure 1B:
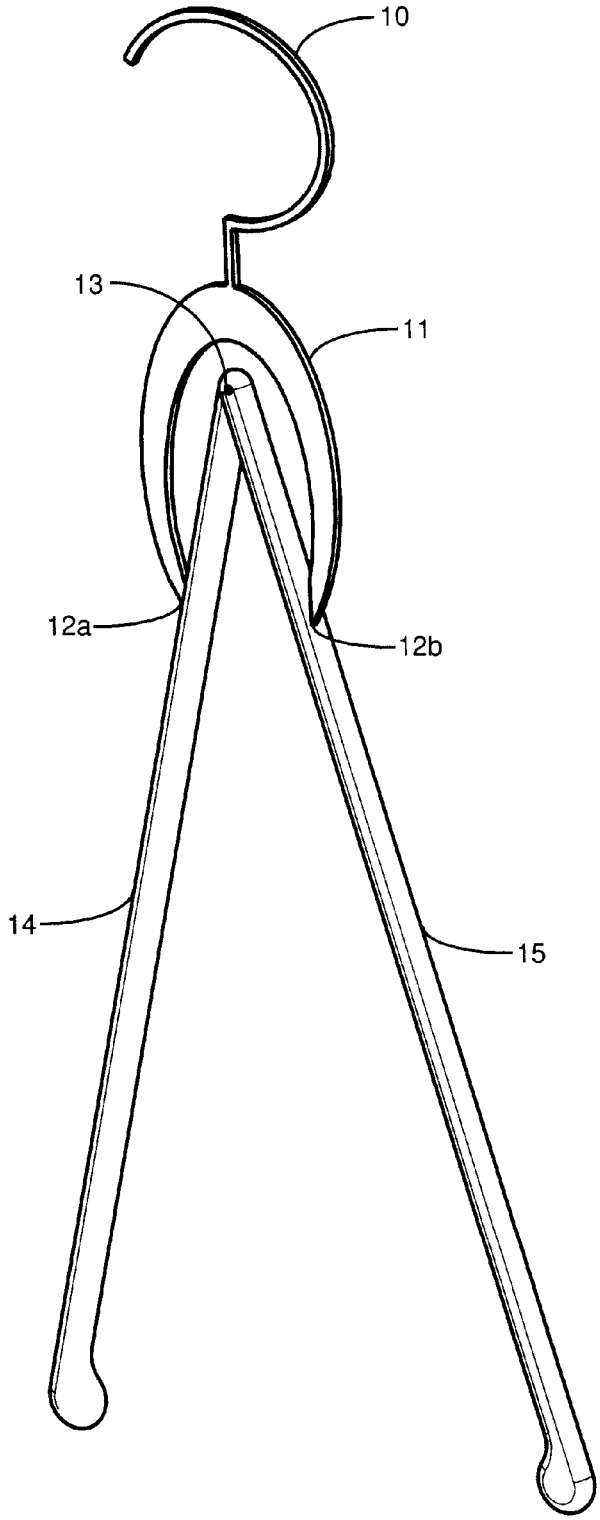
FIG. 1B is a side view showing the hanger of FIG. 1A in its collapsed position.

The spring element 11 imparts a small upwardly-directed bias force to the supporting arms 14 and 15, which keeps them in the extended position. It is noted that the dimensions of the spring 11 are chosen via conventional means so as to maintain the supporting arms 14 and 15 in the extended position under the anticipated maximum weight of a garment being hung from the hanger. In addition, when a downward force is applied by a user to the supporting arms 14 and 15 that just exceeds the biasing force, the supporting arms rotate about their common hinge element 13 into a collapsed position shown in FIG. 1B. As the supporting arms 14 and 15 move into the collapsed position, the spring element 11 elastically stretches, thereby creating an upward force that will return the arms 14 and 15 to their extended position when the user-applied downward force is removed.

In regard to the selection of the spring dimensions described above, it is noted that the present collapsible garment hanger could be produced with various spring sizes so as to accommodate garments of differing weight, while still minimizing the user-applied force required to collapse the hanger. In some cases, producing a collapsible garment hanger in accordance with the present invention that can handle heavier garments may be impractical using just a single spring element as the springs dimensions could become unworkable. However, it is possible to incorporate multiple spring elements in a nested pattern to overcome this problem as the weight-bearing capacity of the hanger would be distributed among the multiple springs, thereby allowing each spring to be of smaller size than if just one spring were employed.

Figure 2:
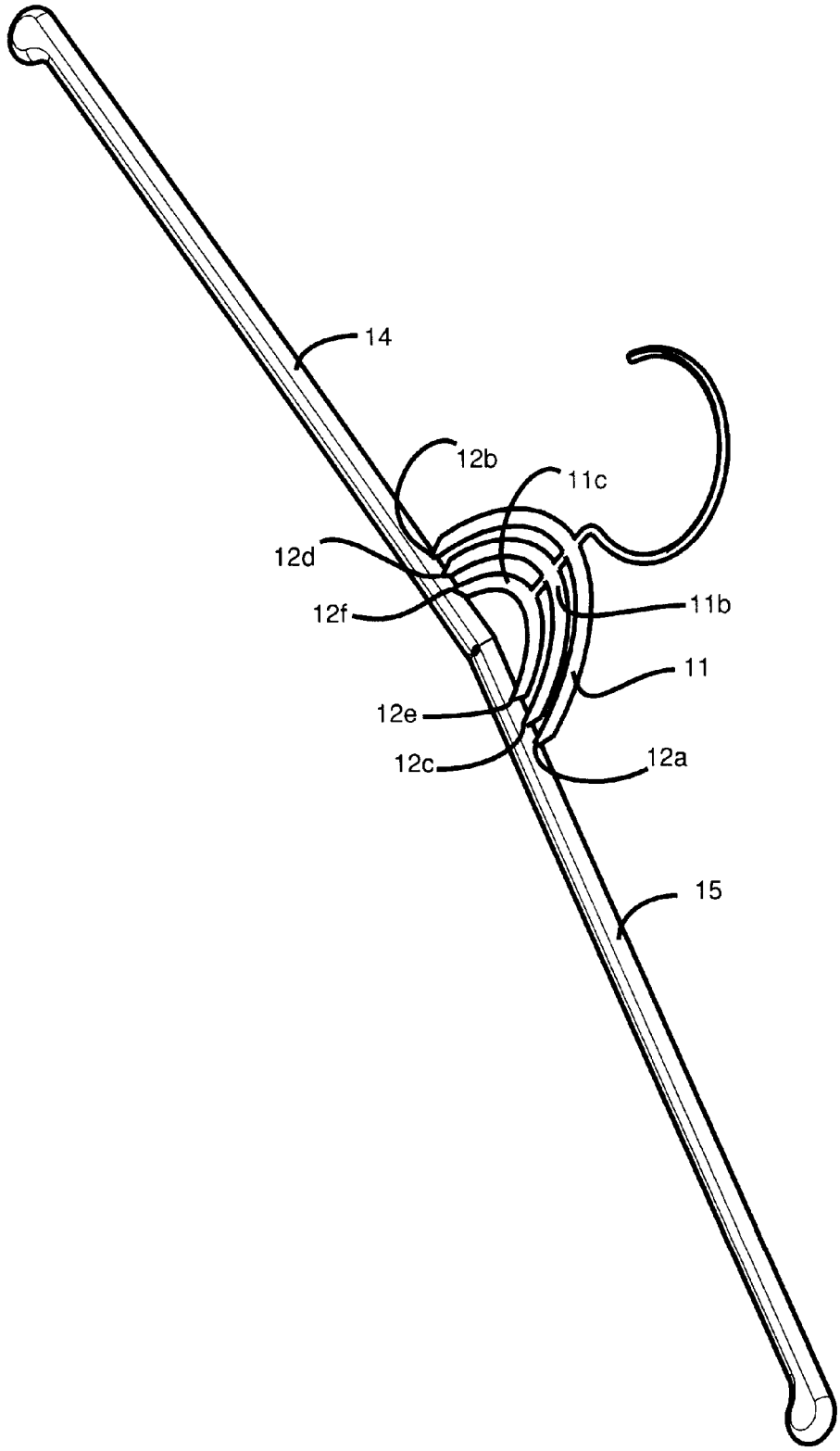
FIG. 2 is a side view of a version of a collapsible garment hanger according to the present invention having multiple spring elements.

Referring to FIG. 2, the multiple spring version would be configured identically to the single spring version described above in connection with FIGS. 1A and 1B. However, the multiple spring version also includes at least one additional spring element, two of which are shown in FIG. 2 and referenced as 11*b* and 11*c*, respectively. Each of the additional spring elements 11*a* and 11*b* are attached at their ends via hinge elements, 12*c–d* and 12*e–f*, to the respective supporting arms 14 and 15. Each additional spring 11*b* and 11*c* extends within the boundary created by the inward-facing surface of the next adjacent, outwardly-positioned spring element, thereby forming the aforementioned nested configuration. Thus, spring 11*b* extends within the bounds of spring 11 and spring 11*c* extends within the bounds of spring 11*b*.

Figure 3A:
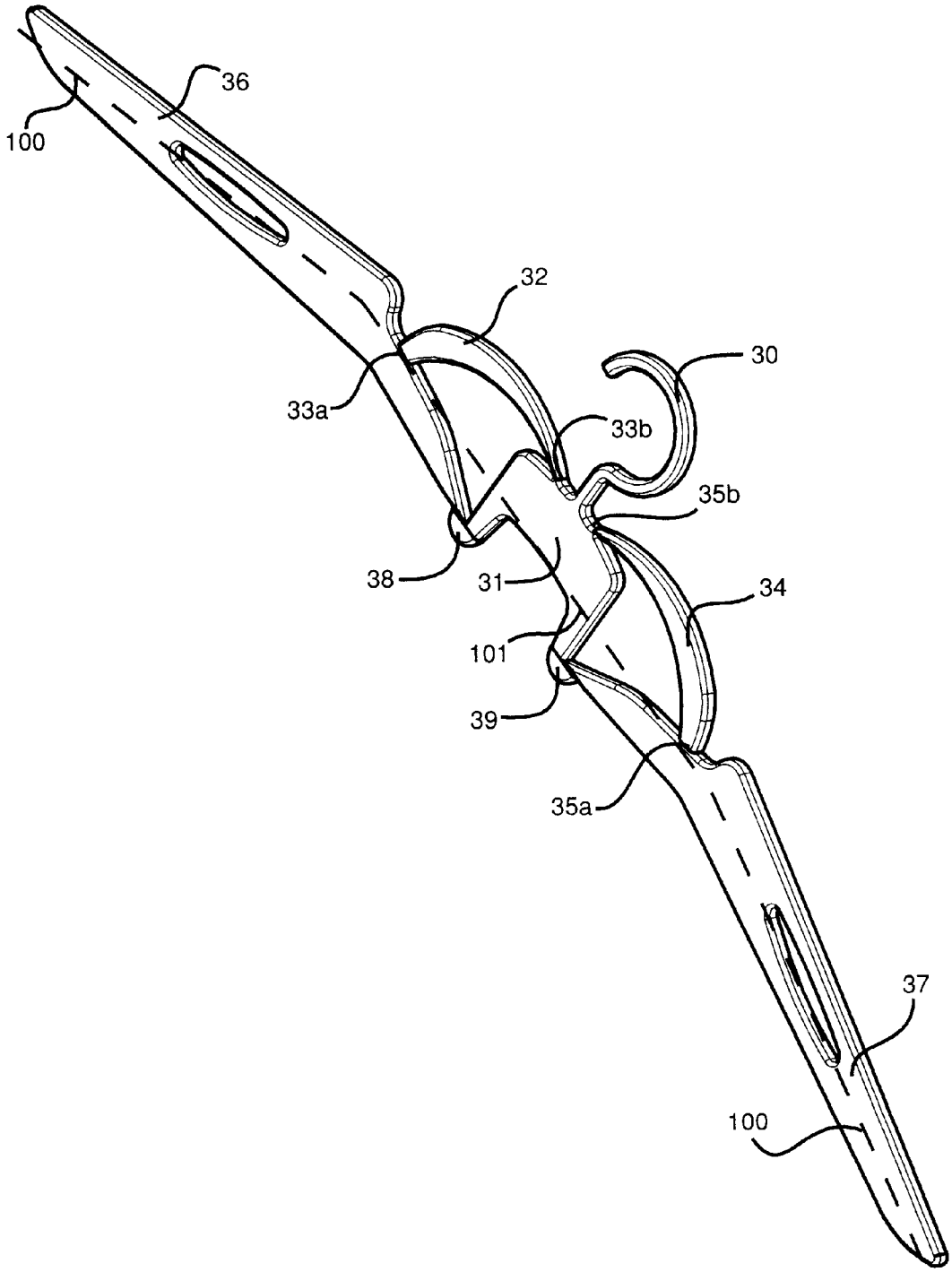
FIG. 3A is a side view of a version of a collapsible garment hanger according to the present invention showing the position of the hanger in its extended position where the spring elements consists of two crescent-shaped springs located on the top of the hanger's base.
Figure 3B:
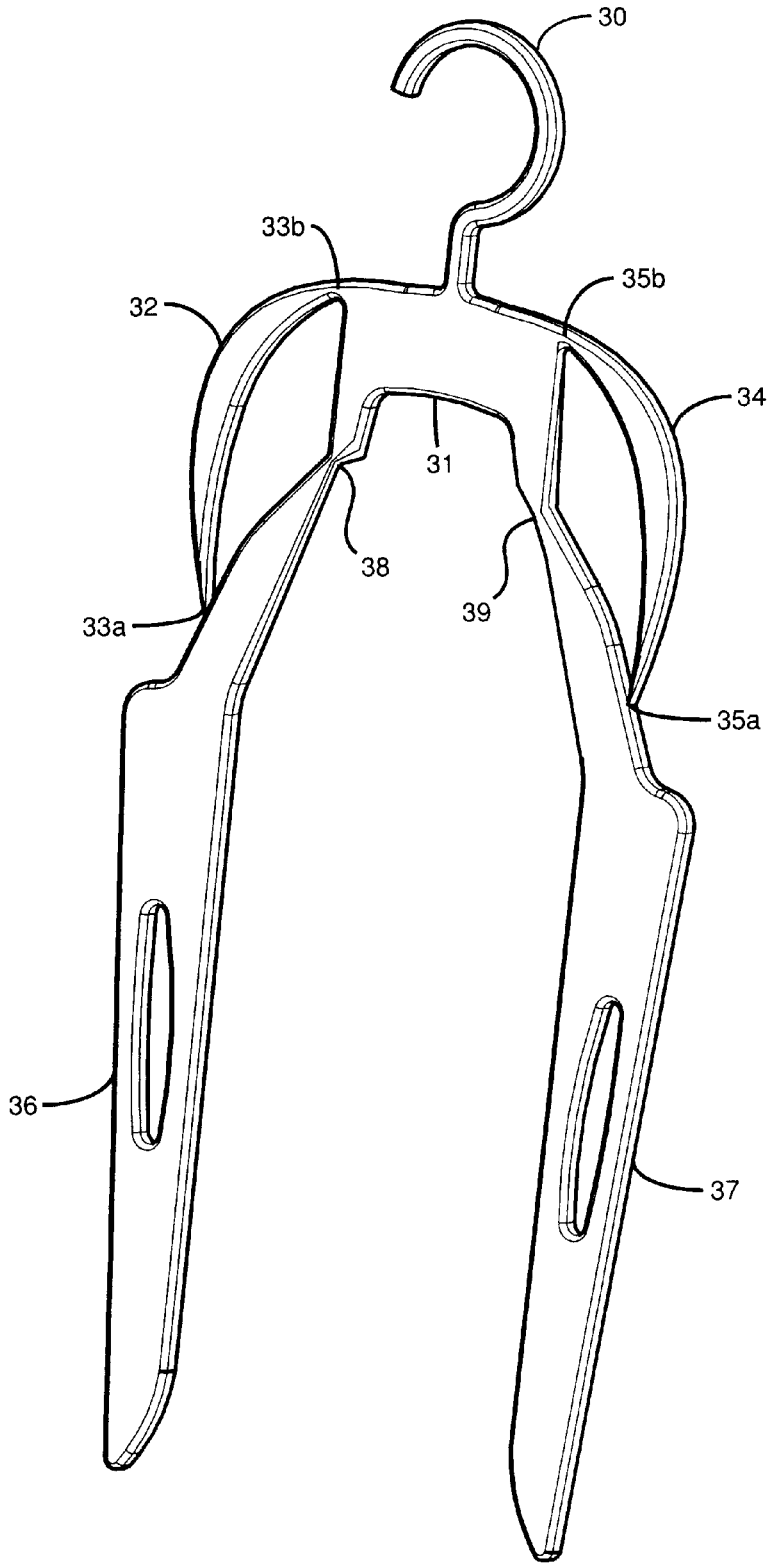
FIG. 3B is a side view showing the hanger of FIG. 3A in its collapsed position.

In an alternate version of a collapsible garment hanger according to the present invention, a pair of spring elements is employed with a different one of the spring elements being used to control the movement of each supporting arm, thus providing a double-pivot spring action. This double-pivot spring action has the advantage of each pivotal range of motion required of a spring element being half of that required in the single-pivot spring action version described previously. Referring to FIG. 3A, where a side view of the garment hanger in its extended position is presented, this alternate version of the collapsible garment hanger includes a hook element 30, which is similar to the hook piece described previously, and which is connected to a base 31. A first supporting arm 36 is connected to the base 31 by a hinge 38. A second supporting arm 37 is connected to the base element 31 by hinge 39. A first spring element 32 is connected to the first supporting arm 36 and to the base element 31 by hinges 33*a* and 33*b*, respectively. A second spring element 34 is connected to the second supporting arm element 37 and to the base element 31 by hinges 35*a* and 35*b*, respectively. When a user applies a downward force to the supporting arms 36 and 37, the spring elements 32 and 34 will stretch allowing the supporting arms 36 and 37 to pivot at hinges 38 and 39 and move into the collapsed position, as shown in FIG. 3B. When the downward force is removed, the supporting arms 36 and 37 will return to their extended position under the influence of an upward force exerted by the stretched spring elements 32 and 34.

Figure 4A:
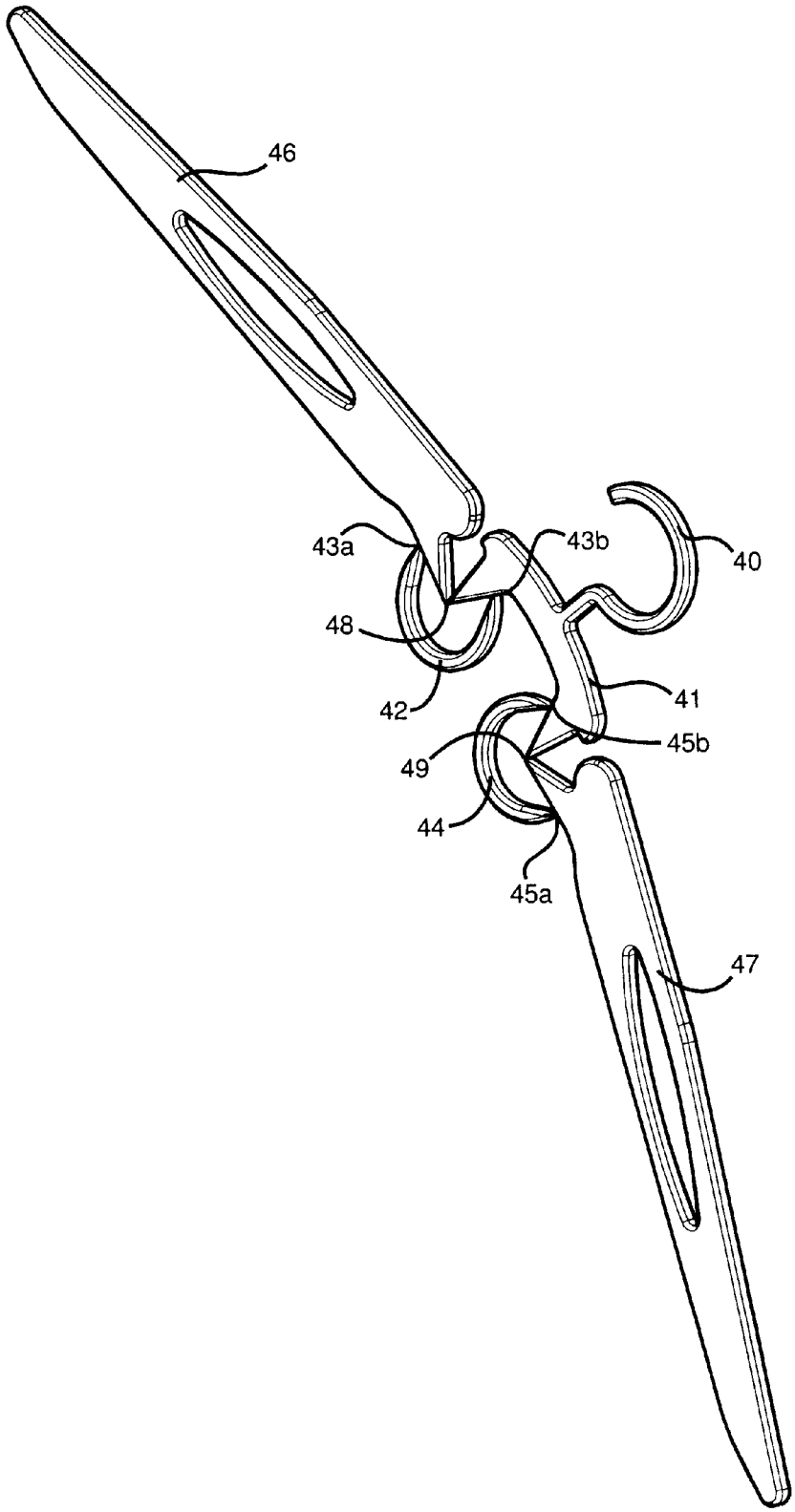
FIG. 4A is a side view of a collapsible garment hanger according to the present invention showing the position of the hanger in its extended position where the spring elements consists of two crescent-shaped springs located on the underside of the hanger's base.
Figure 4B:
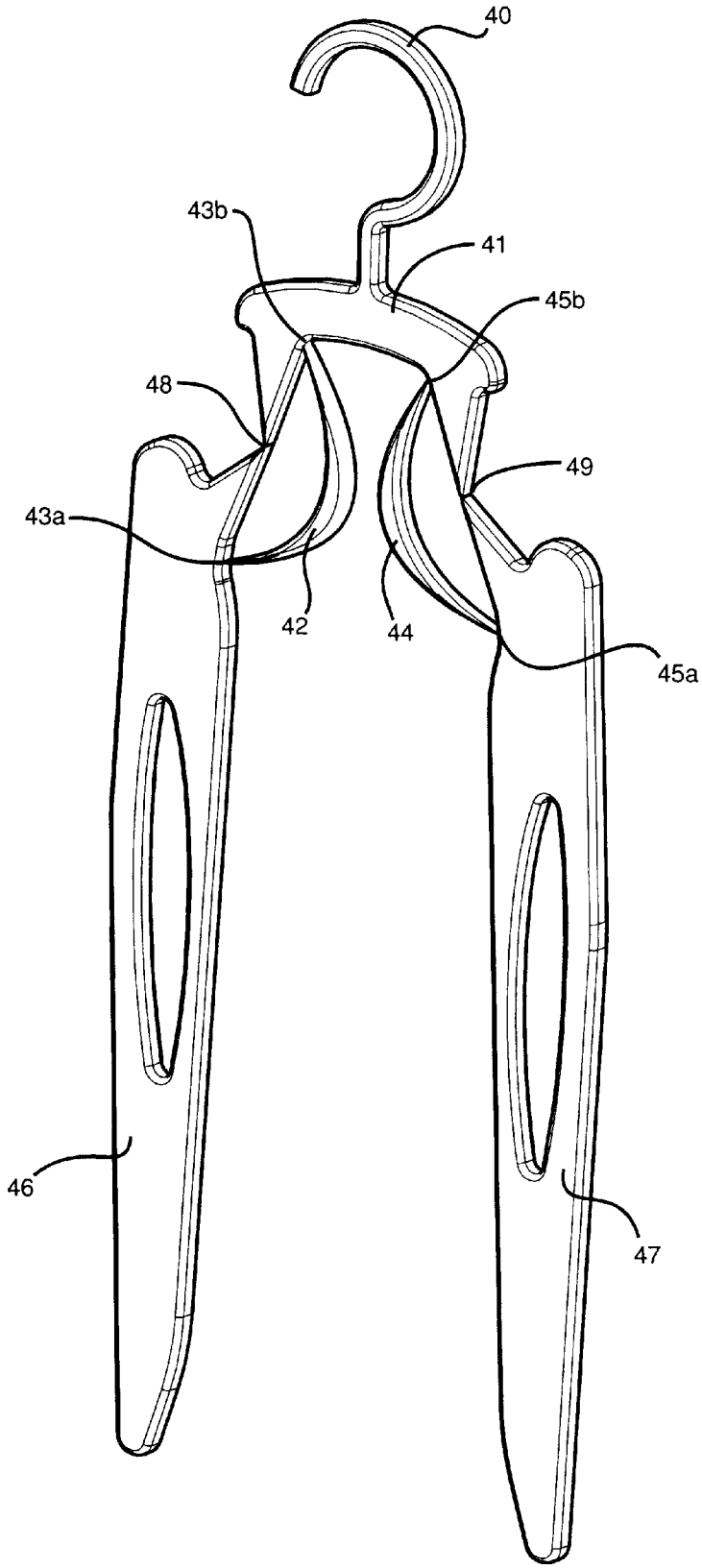
FIG. 4B is a side view showing the hanger of FIG. 4A in its collapsed position.

In a variation of the spring-pair collapsible garment hanger described in connection with FIGS. 3A and 3B, the spring elements are attached underneath the hanger instead. Specifically, referring to FIG. 4A, where a side view of the garment hanger in its extended position is presented, this variation includes a hook element 40, which is connected to a base 41, just as before. In addition, like the previous version, a first supporting arm 46 is connected to the base 41 by a hinge 48, and a second supporting arm element 47 is connected to the base 41 by hinge 49. However, in this present version of the hanger, a first spring element 42 is connected to the bottom surface of the supporting arm 46 and the bottom surface of the base element 41 by hinges 43*a* and 43*b*, respectively. Likewise, a second spring element 44 is connected to the bottom surface of the second supporting arm 47 and the bottom surface of the base 41 by hinges 45*a* and 45*b*, respectively. The operation of this variation of the collapsible garment hanger is identical to the previous spring-pair version, except that instead of the spring elements 42 and 44 being elastically stretched, they are elastically compressed. FIG. 4B shows the underlying spring element version of the hanger in its collapsed position.

In the foregoing spring-pair versions of the present collapsible garment hanger, any type of spring could be employed. However, it is preferred that an integrally molded crescent-shaped spring be used and oriented such that the inner surface faces toward the base.

Figure 5:
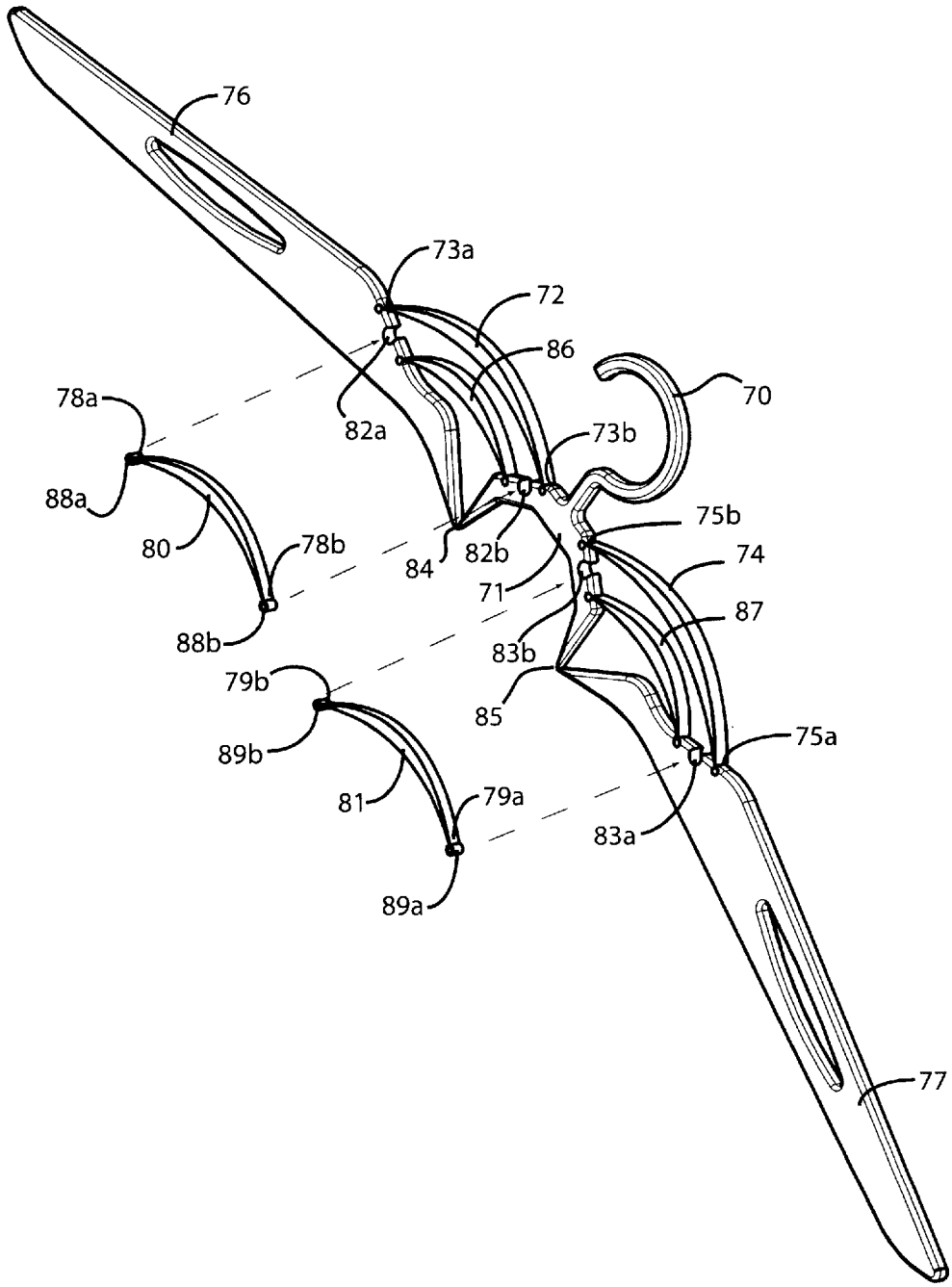
FIG. 5 is a side view of a collapsible garment hanger according to the present invention having multiple spring-pairs arranged in a nested pattern with the potential for receiving or removing push-in spring elements, where the spring elements consist of crescent-shaped springs located on the top of the hanger's base.

The foregoing spring-pair versions of the present collapsible garment hanger can also be configured to include the previously-described multiple spring feature, which in this case would be one or more additional spring pairs. Referring to FIG. 5, a multiple spring-pair version of the present collapsible garment hanger, where the spring elements are attached above the base, is presented. As in the previous spring-pair versions, a hook element 70 is provided for supporting the garment hanger from a clothes rod. A base 71 is connected to the hook element 70. A first supporting arm 76 is connected to the base 71 by a hinge 84. A second supporting arm 77 is connected to the base 71 by hinge 85. A first spring element 72 is connected to the first supporting arm 76 and to the base element 71 by hinges 73*a* and 73*b*, respectively. A second spring element 74 is connected to the second supporting arm 77 and to the base 71 by hinge elements 75*a* and 75*b*, respectively. The first and second spring elements 72 and 74 make a first spring-pair of the hanger. A second spring-pair 86 and 87 is also included in this multiple spring-pair version of the hanger. The spring elements 86 and 87 are connected to the base 71 and supporting arms 76 and 77 via hinges, just as with the first spring-pair 72 and 74. The spring elements on the same side of the hanger, such as springs 72 and 86, form a nested configuration with enough separation between the springs that they do not interfere with each other when the supporting arms are in either the extended or collapsed positions. When a user applies a downward force to the supporting arms 76 and 77, the spring elements 72, 74, 86, and 87 will stretch allowing the supporting arms 76 and 77 to pivot at their hinge 84 and 85 and move into the collapsed position described previously. As before, when the user-applied downward force is removed, the supporting arms 76 and 77 will return to the extended position automatically.

Figure 6:
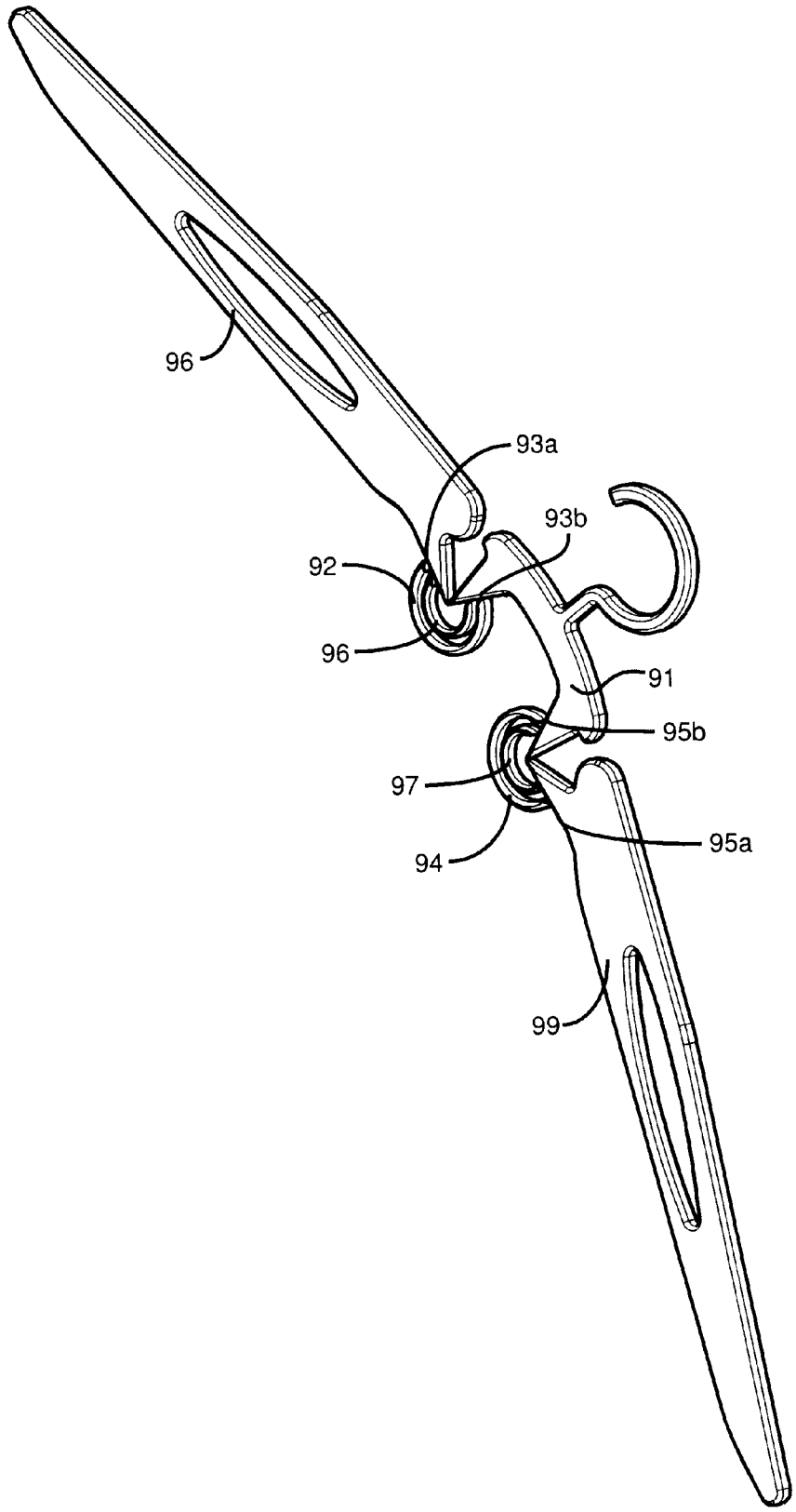
FIG. 6 is a side view of a collapsible garment hanger according to the present invention having multiple spring-pairs arranged in a nested pattern, where the spring elements consists of crescent-shaped springs located underneath the hanger's base.

Referring to FIG. 6, a multiple spring-pair version of the present collapsible garment hanger, where the spring elements are attached underneath the base, is presented. This variation is essentially identical to the above-described multiple spring-pair hanger configuration associated with FIG. 5, except that the first spring element 92 is connected to the bottom surface of the supporting arm 96 and the bottom surface of the base 91 by hinges 93*a* and 93*b*, respectively, and the second spring element 94 is connected to the bottom surface of the second supporting arm 97 and the bottom surface of the base 91 by hinges 95*a* and 95*b*, respectively. The first and second spring elements 92 and 94 represent the first spring-pair of the hanger. A second spring-pair 96 and 97 is also included. Specifically, spring elements 96 and 97 are connected to the base 91 and supporting arms 96 and 97 via hinges, just as with the first spring-pair 92 and 94. Here again, the spring elements on the same side of the hanger, such as springs 92 and 96, form a nested configuration with enough separation between the springs that they do not interfere with each other when the supporting arms are in either the extended or collapsed positions. When a user applies a downward force to the supporting arms 96 and 97, the spring elements 92, 94, 96, and 97 will compress allowing the supporting arms 96 and 97 to pivot at their hinge 94 and 95 and move into the collapsed position described previously. When the user-applied downward force is removed, the supporting arms 96 and 97 will return to the extended position automatically.

The multiple spring-pair hanger configurations could be further modified to allow a user to adjust the hanger's weight handling capacity. Essentially, this is accomplished by making the aforementioned spring elements removable. The user adds or removes spring elements to adjust the weight handling capacity, by changing the force required to collapse the hanger. The removable spring feature can be implemented in any of the previously described versions of the present collapsible garment hanger. For example, referring once again to the multiple spring-pair version of the hanger shown in FIG. 5, a fifth spring element 80 having hinges 78*a* and 78*b* and attachment hubs 88*a* and 88*b* incorporated at its distal ends, can be inserted via the hubs into slot 82*a* on the said first supporting arm 76 and slot 82*b* on the base 71. Likewise, a sixth spring element 81 having hinges 79*a* and 79*b* and attachment hubs 89*a* and 89*b* incorporated at its distal ends, can be inserted via the hubs into slot 83*a* on the said first supporting arm 77 and slot 83*b* on the base 71. The other springs 72, 74, 86 and 87 can be configured to be removable in the same way. Thus, the spring elements become push-in springs that a user can install or remove to control the magnitude of the aforementioned bias force. It is preferred that the spring element in each spring-pair have substantially identical weight handling capacities so that the aforementioned bias and upward forces are balanced between the two supporting arms.

Figure 7:
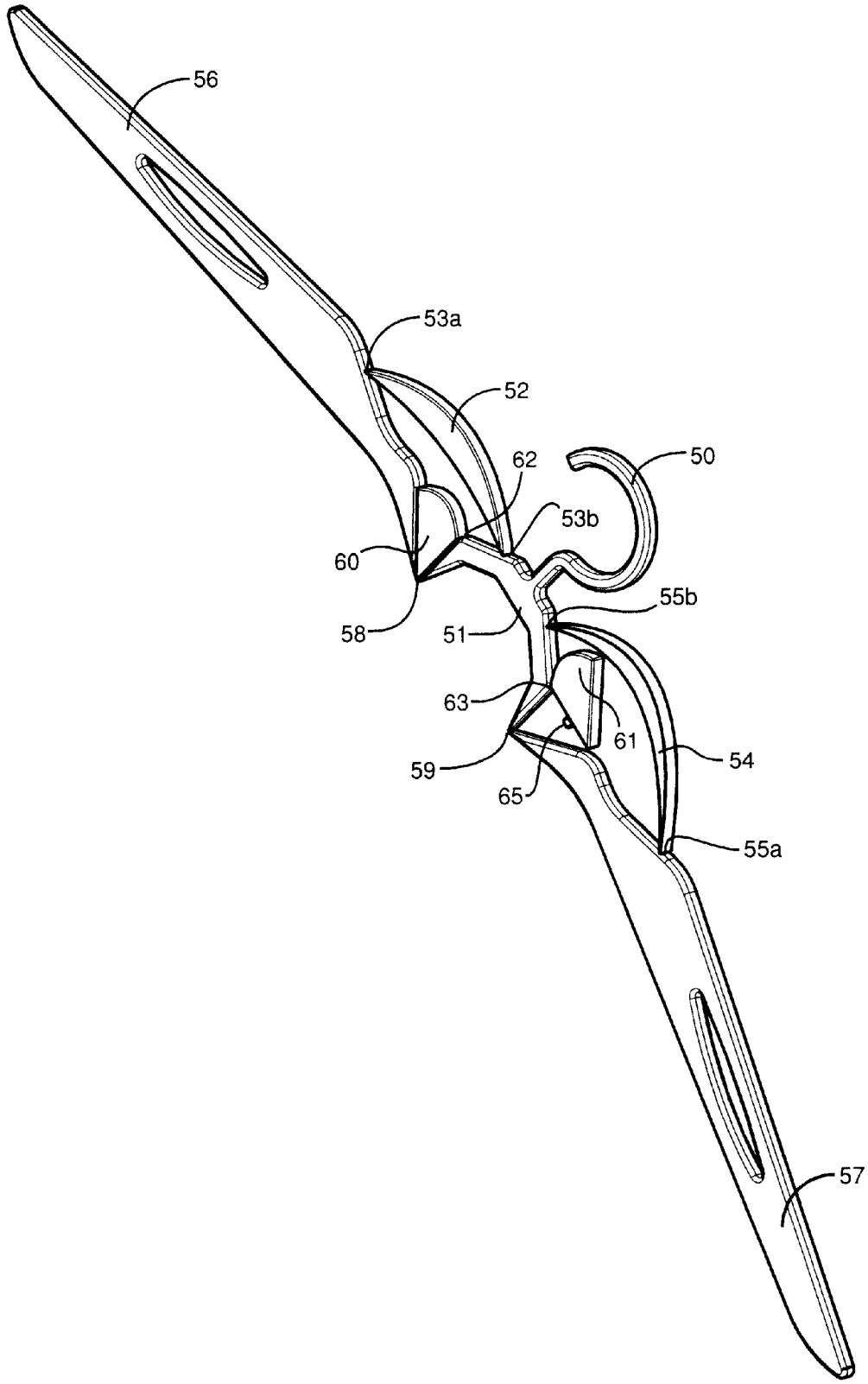
FIG. 7 is a side view of a collapsible garment hanger according to the present invention showing the use of snap-in pre-load stops that can be pushed or snapped into the supporting arms to change the bias force at the hanger's extended position and set the angle of the supporting arms of the hanger.

Another feature applicable to the multiple spring-pair versions of the collapsible garment hanger involves the use of stops referred to as pre-load stops. These stops are used to position the supporting arms in relation to the springs to impart the aforementioned bias force when the arms are in their extended position-thus the name pre-load stops. It has been found that a preload is desirable as the supporting arms of the collapsible hanger tend to sag slightly under the weight of a garment placed on the hanger if left in the "at rest" position. In addition, the stops can be used to create a desired angle between the supporting arms and the base when in the extended position to accommodate the sloping taper associated with most garments hung on a hanger. Generally, the stop feature is implemented by initially molding the supporting arms to attain an "at rest" angle higher than the desired angle intended for hanging garments. This angle can be described as the angle formed between the centerline 100 of a supporting arm and a line 101 passing through the points of connection between the supporting arms and the base, which are depicted as dashed lines in the FIG. 3A. Prior to use, the supporting arms are pulled downward and the stops installed into the base at the hinge. The stops restrict further upward motion of the arms to the desired garment angle while also providing a bias force on the arms that equals or exceeds that of the desired garment weight. Specifically, a pair of stops is employed. Each of these stops is connected to the base adjacent the hinged attachment between the base and a respective one of the supporting arms. The stops contact the supporting arms so as to interfere with their upward movement under the influence of the aforementioned upward force, thereby setting the angle of the supporting arms in relation to the base and the magnitude of the bias force. The stops can be integrally molded and fixed or removable by creating a releasable connection between the stops and the base. For example, removable stops could be configured with a pin that snaps into a receptacle in the base. Further, the stops can be integrally molded and releasable. Specifically, each stop would be molded so as to be hingedly attached via a hinge to the base adjacent the hinged attachment between the base and the adjacent supporting arm. This version of the stop feature is illustrated in FIG. 7. Here, a hook element 50 is provided for supporting the garment hanger from a clothes rod. A base 51 is connected to the hook element 50. A first supporting arm 56 is connected to the base 51 by a hinge 58. A second supporting arm 57 is connected to the base 51 by hinge 59. A first spring element 52 is connected to the first supporting arm 56 and to the base 51 by hinges 53*a* and 53*b*, respectively. A second spring element 54 is connected to the second supporting arm 57 and the base 51 by hinges 55*a* and 55*b*, respectively. A first snap-in pre-load stop 60 is shown inserted into the base element 51 in its engaged position. In the engaged position, the stop 60 contacts supporting arm 56, thereby setting the aforementioned angle, and the magnitude of the biasing force. The magnitude of the biasing force is determined by the stop because the arms are molded with an "at rest" angle that is higher that the desired angle to be created by the stops. The "at rest" angle is the angle formed between the arms and the base when the spring elements are not under any tension or compression. When the arms are pulled down and the stops installed, the arms cannot return to their at rest angle. This results in the springs having some amount of tension (such as would be the case in the versions of the hanger associated with FIGS. 3A and 7) or compression (such as would be the case in the versions of the hanger associated with FIG. 4A). This tension or compression is the biasing force and is set to just exceed the anticipated weight of garments that are to be hung on the hanger. Stop 60 is hingedly attached to the base 51 by hinge 62. A second snap-in pre-load stop 61 is shown rotated about its hinge 63 away from its insertion site on base 51. This is the retracted position of the stops in which the stop is rotated so as to not contact the supporting arm. The insertion site on the base 51 includes a receptacle 64 capable of receiving a retaining pin 65 located on the each of the stops 60 and 61, as best seen on the side of FIG. 7 depicting the retracted stop 61. The pin 65 is preferably sized to create a jam fit with receptacle 64 to hold the stops 60 and 61 in their engaged position, even when the hanger is collapsed. It is noted that in the version where the stops are separate pieces and not integrated via a hinge into the hanger, stops having a range of sizes could be provided so that the bias force and the arm angle can be set by the user.

In regard to the previously-described feature by which the spring element or elements can be varied in dimension and number to optimize the weight capacity of the collapsible garment hanger to handle a specific maximum weight garment, a question arises as to how a user will know the weight handling capacity of a particular hanger. This issue can be resolved by employing a color coding scheme similar to that described in a co-pending U.S. patent application entitled "Collapsible Garment Hanger" which was filed on Mar. 26, 2001 by the inventor of this application, and assigned serial number 09/817,549. The disclosure of this co-pending application is hereby incorporated by reference. Particularly, the color coding scheme as applied to the present collapsible garment hanger not employing removable spring elements involves making the entire hanger or a part thereof a prescribed color representing its weight handling capacity. As for a hanger according to the present invention that does employ the removable spring elements, each spring element (removable or not) is made a color which represents the incremental amount of weight the spring adds to the overall weight handling capacity of the hanger. In this way a user simply adds up the incremental weight handling capacities associated with each spring installed on the hanger to arrive at the overall capacity.

The various versions of the present collapsible garment hanger can be made of any appropriate material and can be an assembly of individual parts if desired. However, it is preferred that the hanger be of one continuous piece of material (with the exception of removable spring elements and stops), such as a one-piece molded plastic structure. In this context, the various aforementioned hinges would be so-called living hinges.

While the invention has been described in detail by specific reference to preferred embodiments thereof, it is understood that variations and modifications thereof may be made without departing from the true spirit and scope of the invention.

Wherefore, what is claimed is:

1. A collapsible garment hanger comprising:

a hook element comprising a hook-shaped piece which extends from approximately the center of a traversely oriented base having two distally located ends;

a first supporting arm which is hingedly attached to a first of said distally located ends of the base;

a second supporting arm which is hingedly attached to a second of said distally located ends of the base;

a first spring element which is hingedly attached to a point on the upper surface of the base between the hook-shaped piece and the attachment point of the first supporting arm to the base at a first end and to the first supporting arm at a second end; and a second spring element which is hingedly attached to a point on the upper surface of the base between the hook-shaped piece and the attachment point of the second supporting arm to the base at a first end and to the second supporting arm at a second end; wherein, said first and second spring elements impart a upwardly directed bias force to the supporting arms so as to respectively keep the first and second supporting arms in an outwardly extended position; and wherein, whenever a downward force which at least exceeds said bias force is applied to one of the supporting arms, that supporting arm rotates about its hinged attachment with the base into a collapsed position and the spring element attached to that supporting arm elastically stretches creating an upward force which returns the arm to its extended position when the downward force is removed.

2. The collapsible garment hanger of claim 1, where the first and second spring elements are crescent-shaped and are attached to the base and their respective supporting arms such that the inner surface of the crescent-shaped spring elements faces toward the hinged connection between the base and their respective supporting arms.

3. The collapsible garment hanger of claim 1, further comprising a pair of stops one of which is connected to said base adjacent the hinged attachment between the base and the first supporting arm and the other of which is connected to said base adjacent the hinged attachment between the base and the second supporting arm, said stops contacting the supporting arms so as to interfere with their upward movement under the influence of said upward force.

4. The collapsible garment hanger of claim 3, wherein the stops are releasably connected to the base.

5. The collapsible garment hanger of claim 1, further comprising a pair of stops one of which is hingedly attached to said base adjacent the hinged attachment between the base and the first supporting arm and the other of which is hingedly attached to said base adjacent the hinged attachment between the base and the second supporting arm, wherein said stops whenever rotated about the hinged attachment into a first position are releasable connected to the base and capable of contacting the supporting arms so as to interfere with their upward movement under the influence of said upward force, and wherein said stops whenever rotated about the hinged attachment into a second position are not capable of contacting the supporting arms and so do not interfere with their upward movement.

6. The collapsible garment hanger of claim 1, further comprising at least one additional pair of spring elements, each spring element of each pair being disposed on opposite sides of the hook-shaped piece and hingedly attached to a point on the upper surface of the base between the hook-shaped piece and the attachment point of the adjacent supporting arm at a first end and to the adjacent supporting arm at a second end, and wherein the spring elements disposed on the same side of the hook-shaped piece are attached to the base and adjacent supporting arm so as to form a nested configuration, and wherein each additional pair of spring elements imparts an additional upwardly directed bias force to the supporting arms so as to respectively keep the first and second supporting arms in an outwardly extended position and whenever a downward force which at least exceeds the combined bias force exerted by each pair of springs is applied to one of the supporting arms, that supporting arm rotates about its hinged attachment with the base into a collapsed position and the spring elements attached to that supporting arm elastically stretch creating a combined upward force which returns the arm to its extended position when the downward force is removed.

7. The collapsible garment hanger of claim 6, wherein spring element exhibits a particular weight handling capacity which adds to the overall weight handling capacity of the hanger, and wherein spring element of each pair of spring elements exhibits substantially the same weight handling capacity.

8. The collapsible garment hanger of claim 6, wherein each spring element is not only hingedly attached, but also releasable attached to the base at its first end and to one of the supporting arms at its other end, such that each of a pair of spring elements disposed on opposite sides of the hook-shaped piece can be installed or removed therefrom to control the magnitude of said bias force and said upward force.

9. The collapsible garment hanger of claim 8, wherein each spring element exhibits a color which represents the incremental amount of weight handing capacity the spring adds to the overall weight handling capacity of the hanger, thereby allowing a user to determine the overall weight handling capacity of the hanger by summing the incremental weight handling capacities associated the particular spring elements installed in the hanger, and to set a desired weight handling capacity of the hanger by installing a particular set of spring elements whose incremental weight handling capacity add up to the desired capacity.

10. A collapsible garment hanger comprising:

a hook-shaped element a base having two distally located ends and wherein said hook-shaped element extends from approximately the center of a top surface of the base between the distally located ends in a substantially perpendicular direction in relation to said top surface;

a first supporting arm which is hingedly attached to a first of said distally located ends of the base;

a second supporting arm which is hingedly attached to a second of said distally located ends of the base;

a first crescent-shaped spring element which is hingedly attached at a first end to a point on a lower surface of the base opposite the surface from which the hook-shaped element extends and at a second end to the first supporting arm such that the first spring element straddles the attachment point of the first supporting arm to the base and the inner surface of the crescent-shaped spring element faces toward the attachment point of the first supporting arm to the base; and a second crescent-shaped spring element which is hingedly attached at a first end to a point on a lower surface of the base opposite the surface from which the hook-shaped element extends and at a second end to the second supporting arm such that the second spring element straddles the attachment point of the second supporting arm to the base and the inner surface of the crescent-shaped spring element faces toward the attachment point of the second supporting arm to the base; and wherein said first and second spring elements imparting a upwardly directed bias force to the supporting arms so as to respectively keep the first and second supporting arms in an outwardly extended position; and wherein, whenever a downward force which at least exceeds said bias force is applied to one of the supporting arms, that supporting arm rotates about its hinged attachment with the base into a collapsed position and the spring element attached to that supporting arm elastically compresses creating an upward force which returns the arm to its extended position when the downward force is removed.

11. The collapsible garment hanger of claim 10, further comprising a pair of stops one of which is connected to the base adjacent the hinged attachment between the base and the first supporting arm and the other of which is connected to the base adjacent the hinged attachment between the base and the second supporting arm, said stops contacting the supporting arms so as to interfere with their upward movement under the influence of said upward force.

12. The collapsible garment hanger of claim 11, wherein the stops are releasably connected to the base.

13. The collapsible garment hanger of claim 10, further comprising a pair of stops one of which is hingedly attached to the base adjacent the hinged attachment between the base and the first supporting arm and the other of which is hingedly attached to the base adjacent the hinged attachment between the base and the second supporting arm, wherein said stops whenever rotated about the hinged attachment into a first position are releasable connected to the base and capable of contacting the supporting arms so as to interfere with their upward movement under the influence of said upward force, and wherein said stops whenever rotated about the hinged attachment into a second position are not capable of contacting the supporting arms and so do not interfere with their upward movement.

14. The collapsible garment hanger of claim 10, further comprising at least one additional pair of spring elements, each spring element of each pair being disposed on opposite sides of the base and hingedly attached at a first end to a point on a lower surface of the base opposite the surface from which the hook-shaped element extends and at a second end to the adjacent supporting arm, and wherein the spring elements disposed on the same side of the hook-shaped element are attached to the base and adjacent supporting arm so as to form a nested configuration, and wherein each additional pair of spring elements imparts an additional upwardly directed bias force to the supporting arms so as to respectively keep the first and second supporting arms in an outwardly extended position and whenever a downward force which at least exceeds the combined bias force exerted by each pair of springs is applied to one of the supporting arms, that supporting arm rotates about its hinged attachment with the base into a collapsed position and the spring elements attached to that supporting arm elastically compress creating a combined upward force which returns the arm to its extended position when the downward force is removed.

15. The collapsible garment hanger of claim 14, wherein spring element exhibits a particular weight handling capacity which adds to the overall weight handling capacity of the hanger, and wherein spring element of each pair of spring elements exhibits substantially the same weight handling capacity.

16. The collapsible garment hanger of claim 14, wherein each spring element is not only hingedly attached, but also releasable attached to the base at its first end and to one of the supporting arms at its other end, such that each of a pair of spring elements disposed on opposite sides of the base can be installed or removed therefrom to control the magnitude of said bias force and said upward force.

17. The collapsible garment hanger of claim 16, wherein each spring element exhibits a color which represents the incremental amount of weight handing capacity the spring adds to the overall weight handling capacity of the hanger, thereby allowing a user to determine the overall weight handling capacity of the hanger by summing the incremental weight handling capacities associated the particular spring elements installed in the hanger, and to set a desired weight handling capacity of the hanger by installing a particular set of spring elements whose incremental weight handling capacity add up to the desired capacity.

18. A collapsible garment hanger comprising:

a hook element;

a first supporting arm element and a second supporting arm element wherein both said supporting arm elements are connected pivotally at one end by a first hinge element;

a first spring element extending at its midpoint from said hook element with one end terminating at said first arm element and the second end terminating at said second arm element;

said first spring element being connected to said first arm element by a second hinge element, and said first spring element being connected to said second arm element by a third hinge element; and at least one additional spring element hingedly attached at one end to said first arm element and at the other end to said second arm element and extending between its ends within a region bounded by the inward-facing surface of an adjacent, outwardly-disposed spring element so as to form a nested configuration; and wherein, said spring elements impart an upwardly directed bias force to the supporting arms so as to respectively keep the first and second supporting arms in an outwardly extended position; and wherein, whenever a downward force which at least exceeds said bias force is applied to one of the supporting arms, that supporting arm rotates about the first hinge element into a collapsed position and the spring elements elastically stretch creating an upward force which returns the arm to its extended position when the downward force is removed.

19. The collapsible garment hanger of claim 18, wherein each additional spring element is not only hingedly attached, but also releasable attached to the supporting arms, such that each additional spring element can be installed or removed to control the magnitude of said bias force and said upward force.

20. The collapsible garment hanger of claim 19, wherein each spring element exhibits a color which represents the incremental amount of weight handing capacity the spring adds to the overall weight handling capacity of the hanger, thereby allowing a user to determine the overall weight handling capacity of the hanger by summing the incremental weight handling capacities associated the particular spring elements installed in the hanger, and to set a desired weight handling capacity of the hanger by installing a particular set of spring elements whose incremental weight handling capacity add up to the desired capacity.

* * * * *